United States Patent [19]

Gunderson

[11] Patent Number: 4,513,964

[45] Date of Patent: Apr. 30, 1985

[54] PORTABLE SHUFFLEBOARD COURT

[76] Inventor: Arthur S. Gunderson, P.O. Box 215, 306 Illini Dr., Minooka, Ill. 60447

[21] Appl. No.: 126,805

[22] Filed: Mar. 3, 1980

Related U.S. Application Data

[63] Continuation-in-part of Ser. No. 001,508, Jan. 8, 1979, abandoned.

[51] Int. Cl.[3] ..... A63F 3/00

[52] U.S. Cl. ..... 273/126 R

[58] Field of Search ..... 273/126 R, 126 A, 85 R, 273/85 A, 286, 186 R, 183 A, 195 R, 195 B, 121 273/121 R, 176 R, 115 R, 85

[56] References Cited

U.S. PATENT DOCUMENTS 336,179 2/1886 Vagelsang ..... 273/126 R
748,298 12/1903 Monson ..... 273/126 R
877,814 1/1908 Wallesten ..... 273/286

FOREIGN PATENT DOCUMENTS 1501915 10/1967 France ..... 273/286

*Primary Examiner*—Richard C. Pinkham
*Assistant Examiner*—T. Brown
*Attorney, Agent, or Firm*—Ernest Kettleson

[57] ABSTRACT

A portable shuffleboard court comprising a length of flexible sheet material having the markings of a shuffleboard court printed on one side thereof. The shuffleboard court may be rolled up into a compact unit when not in use. When unrolled for use, anchor holes and pins are provided at each opposite end to hold the shuffleboard court in a flat stretched out position. Rigid elongated clips are provided for attachment along each opposite side edge to make the flexible sheet lie flat when rolled out. The flexible sheet may be made of plastic material. The shuffleboard discs and cues may also be made of plastic material.

5 Claims, 8 Drawing Figures

PORTABLE SHUFFLEBOARD COURT

BACKGROUND OF THE INVENTION

This application is a continuation-in-part of my copending application Ser. No. 001,508 filed Jan. 8, 1979 (Abandoned).

This invention relates to the field of games which are played on a sliding friction surface, and particularly to the well-known game of shuffleboard.

The game is typically played on a permanently installed shuffleboard court made of concrete and with the appropriate markings printed thereon. Such installations are expensive, and cannot be moved from place to place, therefore limiting the places and times when the game of shuffleboard can be played.

Since the dimensions of a regulation size shuffleboard court are rather large, being normally 52 feet long by 6 feet wide, it would be extremely cumbersome to provide a portable shuffleboard court made of a rigid material. If it were made in sections of rigid pieces fastened together in some way, there would be joints extending transversely across the playing surface which would interfere with the shuffleboard discs as they slid from one end of the shuffleboard court to the other. It is desirable to have a continuous smooth surface for a shuffleboard court, and the flexible sheet material in accordance with the present invention meets this objective, while at the same time being portable in that it may be rolled up into a compact unit when not in use.

SUMMARY OF THE INVENTION

It is an object of the invention to provide a portable shuffleboard court of flexible sheet material which may be rolled into a compact unit for carrying purposes, and for storing.

It is an object of the invention to provide a portable shuffleboard court in which the playing area comprises one continuous length of uniform sliding friction surface unbroken by lateral joints or seams.

It is an object of the invention to provide a portable shuffleboard court comprising a continuous length of flexible sheet material having anchor means at each opposite end to maintain the playing surface taut in the longitudinal direction.

It is an object of the invention to provide a portable shuffleboard court comprising a continuous length of flexible sheet material having rigid elongated clip means along each opposite side edge to maintain the playing surface flat when rolled out.

It is an object of the invention to provide a portable shuffleboard court of flexible sheet material in which such flexible sheet material is plastic, and including shuffleboard discs and cues also made of plastic material.

DESCRIPTION OF PREFERRED EMBODIMENT

Figure 1:
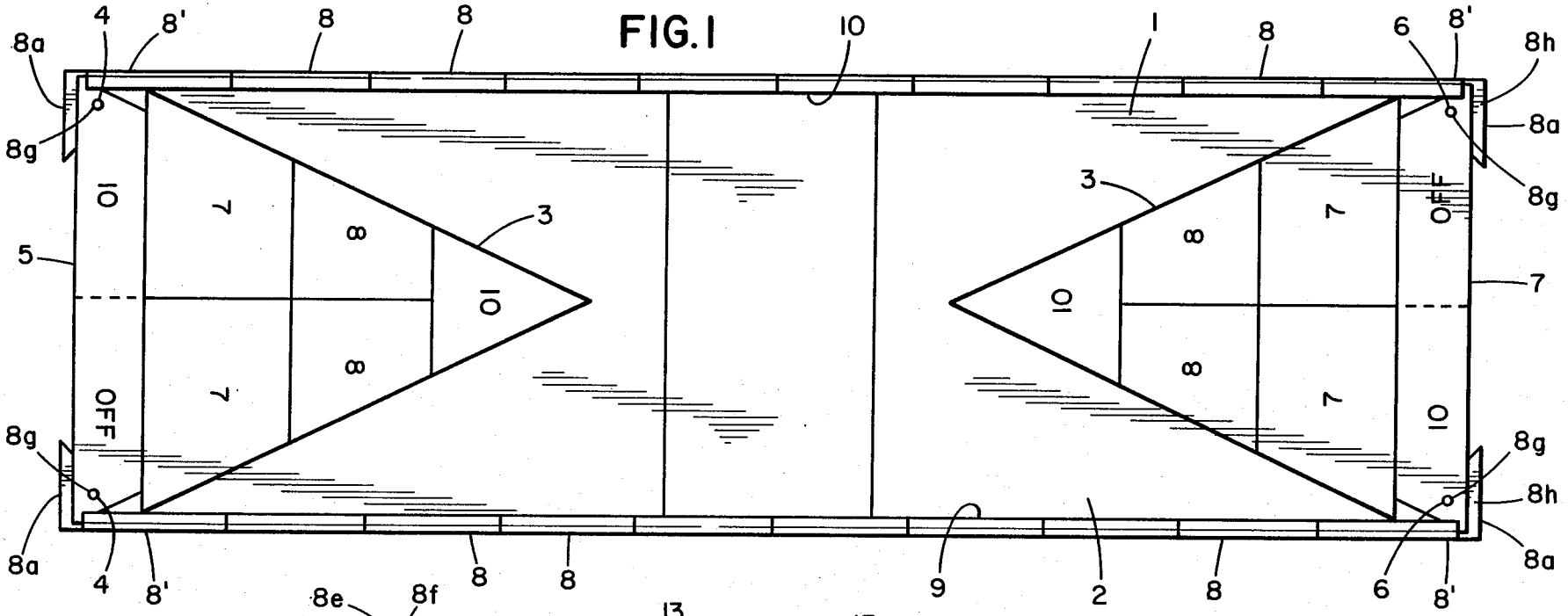
FIG. 1 is a plan view of a portable shuffleboard court in accordance with this invention.
Figures 2, 3, 4, 5, 6:
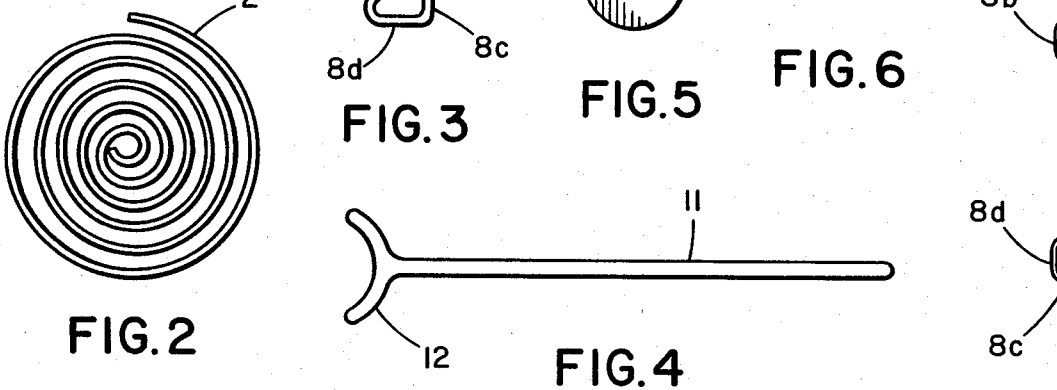
FIG. 2 is a side elevation view of a portable shuffleboard court made of flexible sheet material in accordance with this invention shown rolled up for carrying purposes and for storage.
FIG. 3 is a side elevation view of anchor clips for use along the side edges of the portable shuffleboard court in accordance with this invention.
FIG. 4 is a plan view of a shuffleboard cue in accordance with this invention.
FIG. 5 is a plan view of a shuffleboard disc in accordance with this invention.
FIG. 6 is a side elevation view of a shuffleboard disc in accordance with this invention.
Figure 7:
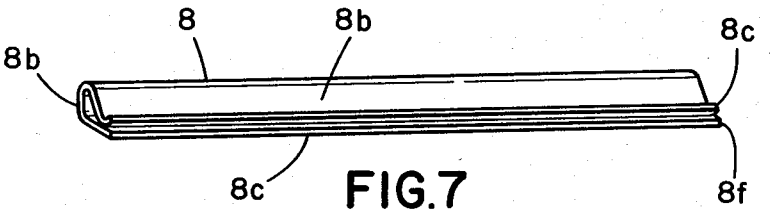
FIG. 7 is a perspective enlarged view of one of the rigid elongated clips for attachment to the side edge of the flexible sheet material to hold it flat when rolled out.
Figure 8:
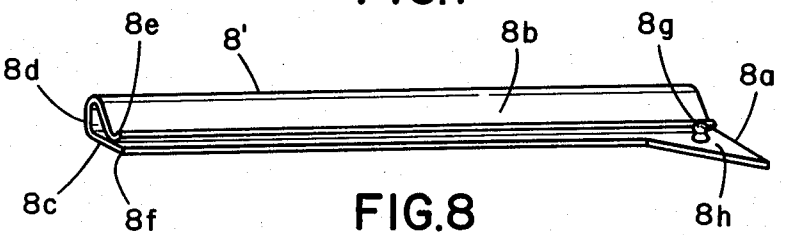
FIG. 8 is a perspective view of one of the elongated end clips for attachment along the side edge of the flexible sheet material adjacent an end thereof.

A portable shuffleboard court 1 comprises a continuous length of flexible sheet material 2 on which are printed or otherwise affixed, the well-known shuffleboard markings 3.

The length of flexible sheet material 2 may be made of a flexible plastic, rubber or of any flexible sheet material which may be rolled up for storage and carrying, and which may be unrolled into a flat playing surface for use as a shuffleboard court. The peripheral configuration of flexible sheet 2 is typically rectangular. The playing surface of flexible sheet 2 is preferably continuous, unbroken and imperforate.

The dimensions of the flexible sheet material 2 are 52 feet in length and 6 feet in width for a regulation size shuffleboard court. It is understood, however, that other sizes may be used within the scope of this invention, including miniaturized versions of shuffleboard courts, particularly for use and enjoyment in recreation rooms of homes and other locations which are not large enough for regulation size shuffleboard.

A plurality of anchor holes 4 are provided at the first end 5 of the flexible sheet 2, through which anchoring devices described hereinafter may be inserted to hold the end 5 securely in place when the flexible sheet 2 is unrolled and made ready for use. Another plurality of holes 6 are provided at the opposite end 7 through which similar anchoring devices may be inserted to hold the opposite end 7 securely fastened for use, and also to maintain the longitudinal dimension of the flexible sheet 2 taut.

Rigid elongated clips 8 are provided for attachment along side edge 9 and opposite side edge 10 of the flexible sheet 2. The elongated clips 8 grip the respective edges 9 and 10 and are clipped to the flexible sheet 2 along opposite sides in end-to-end abutting relationship. The rigid elongated clips 8 hold the flexible sheet 2 flat when so attached. At each end of each side edge 9 and 10 of flexible sheet 2, special rigid elongated clips 8' are attached which include a triangular plate **8*a*** at the outwardly projecting end.

The rigid elongated clips 8 and 8' are preferably of a resilient relatively rigid material having spring characteristics, whereby the converging elongated side members **8*b* and 8*c* may be spread apart sufficiently to receive the side edge of flexible sheet 2 therebetween. The converging side members 8*b* and 8*c* then grip and hold the side edge under tension to maintain the flexible sheet 2 flat when the rigid elongated clips 8 and 8'** are attached along the side edges.

Elongated converging side member **8*b* is integrally formed and connected to elongated base 8*d* of elongated clips 8 and 8' and the side member 8*b* extends at an acute angle to the base 8*d*. Converging side member 8*c* is integrally formed with and connected to base 8*d*, and extends therefrom at substantially a right angle. When affixing the clips 8 and 8' to the respective side edges 9 and 10 of flexible sheet 2, the side members 8c are placed under the flexible sheet 2 for laying flat on the ground or other surface on which the sheet 2** is laid.

The free edge 8e of converging side members 8b is reversely bent to provide a spaced apart inwardly tapering entrance region along free edge 8e, between it and the corresponding free edge 8f of the converging side member 8c, both of which converge to a point where they are spaced apart a distance less than the thickness of the flexible sheet 2. In this way, the edges 9 and 10 of flexible sheet 2 are firmly gripped between the converging side members 8b and 8c of the clips 8 and 8' when clipped thereon. A sufficient number of clips 8 and 8' are provided, whereby they abut in end-to-end relationship throughout the length of the side edges 9 and 10 of flexible sheet 2 when it is laid out flat and the clips 8 and 8' are attached.

The triangular plate 8a of each clip 8' is formed as an integral extension of the bottom converging side member 8c at the outwardly extending end thereof. An anchor post 8g is affixed to the upwardly facing surface 8h of triangular plate 8a which faces in the direction toward converging side member 8b of clips 8'. When clips 8' are clipped to the respective side edges 9 and 10 of flexible sheet 2 at respective ends thereof, the anchor posts 8g projecting upwardly from each triangular plate 8a are in registration with the anchor holes 4 and 6 respectively at each opposite end 5 and 7 of the flexible sheet 2. The anchor posts 8g are of slightly enlarged diameter at their free ends which are slightly larger than the anchor holes 4 and 6. The enlarged diameter ends of anchor posts 8g are slightly resilient to enable forcing through the respective anchor holes 4 and 6 whereupon the ends 5 and 7 of flexible sheet 2 are securely held in place.

A plurality of cues 11 are provided having an arcuate contact end 12 of configuration and dimension conforming to the peripheral configuration and dimension of shuffleboard discs 13.

In use, the rolled up flexible sheet 2 having the shuffleboard markings 3 thereon is unrolled on the ground or on the floor of a building if used inside. The anchor posts 8g projecting from the triangular plates 8a of the elongated clips 8' clipped to each side at the end thereof are inserted into the respective anchor holes 4 and 6 at each opposite end to hold the flexible sheet 2 in the longitudinal direction and to maintain it taut in the longitudinal direction when anchored. The anchor clips 8 are then secured in abutting end-to-end relationship along each opposite edge 9 and 10 to hold it flat and ready for play.

The portable shuffleboard court is then ready for play by using the shuffleboard cues 11 to slide the shuffleboard discs 13 from one end of the shuffleboard court 5 towards the opposite end 7 and vice versa. The game is played on the portable shuffleboard court in accordance with this invention in the same manner as the game is played on the customary permanent shuffleboard courts typically made of concrete.

When the players are through playing, the anchor posts 8g are removed from the anchor holes 4 and 6, the anchor clips 8 and 8' are removed from the side edges 9 and 10. The flexible sheet 2 is then rolled into a compact rolled-up unit which may be conveniently carried to a storage room and stored compactly out of the way until it is desired for future use.

I claim:

1. A portable shuffleboard court, comprising a length of flexible sheet material having a first end and a second opposite end, shuffleboard markings provided on said flexible sheet material, stiffening means to maintain said flexible sheet material flat for playing, anchor means to anchor said first and second ends for playing, said stiffening means including a plurality of substantially rigid elongated clips for detachably securing to side edges of said length of flexible sheet material, wherein a first one of said rigid elongated clips has a first end portion adjacent said first end of said length of flexible sheet material on a first side thereof, said first end portion including a laterally projecting planar portion, wherein said anchor means includes a first fastening member on said laterally projecting planar portion for cooperative fastening engagement with a corresponding second fastening member on said first end of said length of flexible sheet material.

2. A portable shuffleboard court as set forth in claim 1, wherein said laterally projecting planar portion of said elongated clip extends under said length of flexible sheet material when laid out flat for playing, said first fastening member on said planar portion is an upwardly extending fastening stud, said corresponding second fastening member on said first end of said length of flexible sheet material is a fastening socket in the form of an aperture to receive said fastening stud therethrough to anchor said first end of said length of flexible sheet material to said planar portion of said elongated clip.

3. A portable shuffleboard court as set forth in claim 2, wherein a second one of said substantially rigid elongated clips has a first end portion adjacent said second end of said length of flexible sheet material on said first side thereof, a third one of said clips has a first end portion adjacent said first end of said length of flexible sheet material on a second opposite side thereof, a fourth one of said clips has a first end portion adjacent said second end of said length of flexible sheet material on said second opposite side thereof, said first end portion of said second, third and fourth clips including respective laterally projecting planar portions, wherein said anchor means includes a first fastening member on each of said laterally projecting planar portions for cooperative fastening engagement with respective corresponding second fastening members on said first and second ends of said length of flexible sheet material.

4. A portable shuffleboard court as set forth in claim 3, wherein each of said laterally projecting planar portions of said elongated clips extends under said length of flexible sheet material when laid out flat for playing, said first fastening members on said planar portions are upwardly extending fastening studs, said corresponding second fastening members on said first and second ends of said length of flexible sheet material are fastening sockets in the form of apertures to receive respective ones of said fastening studs therethrough to anchor said respective first and second ends of said length of flexible sheet material to said planar portions of corresponding ones of said elongated clips.

5. A portable shuffleboard court as set forth in claim 4, wherein said fastening studs include respective free ends of enlarged diameter and a shank portion of reduced diameter, said enlarged diameter free ends being slightly resilient, said fastening sockets in the form of apertures having a diameter slightly smaller than that of said enlarged free ends and slightly larger than that of said reduced diameter shank portions.

* * * * *